US011524335B2

(12) United States Patent
Shuto et al.

(10) Patent No.: US 11,524,335 B2
(45) Date of Patent: Dec. 13, 2022

(54) CASTING DEVICE AND CASTING METHOD

(71) Applicant: HONDA MOTOR CO., LTD., Tokyo (JP)

(72) Inventors: Kenichi Shuto, Tochigi (JP); Masayuki Hattori, Tochigi (JP); Takashi Idegomori, Tochigi (JP); Hiroshi Takahashi, Tochigi (JP); Tsuginori Usami, Tochigi (JP); Keisuke Kagami, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 232 days.

(21) Appl. No.: 17/041,152

(22) PCT Filed: Mar. 26, 2019

(86) PCT No.: PCT/JP2019/012855
§ 371 (c)(1),
(2) Date: Sep. 24, 2020

(87) PCT Pub. No.: WO2019/189184
PCT Pub. Date: Oct. 3, 2019

(65) Prior Publication Data

US 2021/0008614 A1 Jan. 14, 2021

(30) Foreign Application Priority Data

Mar. 26, 2018 (JP) ..... JP2018-058585

(51) Int. Cl.
*B22D 18/04* (2006.01)

(52) U.S. Cl.
CPC ..... *B22D 18/04* (2013.01)

(58) Field of Classification Search
CPC ..... B22D 18/04; B22D 35/00; B22D 35/04; B22D 35/045; B22D 35/06; B22C 9/06; B22C 9/08; B22C 9/082; B22C 9/086
See application file for complete search history.

(56) References Cited

U.S. PATENT DOCUMENTS

| | | | | |
|---|---|---|---|---|
| 6,422,294 | B1 | 7/2002 | Murata et al. | |
| 2016/0339514 | A1 | 11/2016 | Urhahn et al. | |
| 2019/0217378 | A1 * | 7/2019 | Sugiyama | B22C 9/082 |

FOREIGN PATENT DOCUMENTS

| | | |
|---|---|---|
| JP | 08-174147 | 7/1996 |
| JP | 2605054 | 2/1997 |

(Continued)

OTHER PUBLICATIONS

International Search Report, dated May 21, 2019, 2 pages.

(Continued)

*Primary Examiner* — Kevin P Kerns
*Assistant Examiner* — Steven S Ha
(74) *Attorney, Agent, or Firm* — Rankin, Hill & Clark LLP

(57) ABSTRACT

A casting device capable of manufacturing products in a short cycle time; and a casting method using this casting device. The casting device includes: a pressurized furnace; a mold having a cavity formed therein; a stalk; at least a first hot water tap in a cylindrical shape connecting the cavity and an end of the stalk on the downstream side in the molten metal filling direction and guiding the molten metal supplied to the stalk to inside the cavity; and a filter member provided in the first hot water tap. The filter member includes a flange extending along the extension direction of the first hot water tap and abutting an inner wall surface of the first hot water tap. A coolant passage having coolant flowing therethrough is provided in the vicinity of the inner wall surface.

14 Claims, 11 Drawing Sheets

(56) References Cited

FOREIGN PATENT DOCUMENTS

| | | | | |
|---|---|---|---|---|
| JP | 2000-312962 | | 11/2000 | |
| JP | 2005-131658 | | 5/2005 | |
| JP | 2011-235330 | | 11/2011 | |
| JP | 2012-152798 | | 8/2012 | |
| JP | 2015-047628 | | 3/2015 | |
| WO | WO-2017212565 | A1 * | 12/2017 | ..... B22C 9/082 |

OTHER PUBLICATIONS

Chinese Office Action dated Apr. 30, 2021 with English Translation, 15 pages.

Chen Zheng, et al. "Knowledge of Specialty Practice in Material Forming", pp. 53-54, China University of Mining and Technology Press, Jan. 2016, 4 p. (Explanation of the relevance of this document is discussed in the attached English translation of the Chinese Office Action).

* cited by examiner

CASTING DEVICE AND CASTING METHOD

TECHNICAL FIELD

The present invention relates to a casting device and a casting method.

BACKGROUND ART

A cylinder head in an engine is often manufactured based on a so-called low pressure casting method (see, for example, Patent Document 1). In the low pressure casting method, a pressure is applied to molten metal which is stored within a furnace provided immediately below a mold, and thus the molten metal is filled into a cavity portion through a cylindrical stalk provided within the furnace and a cylindrical sprue portion that connects the stalk and the cavity portion formed within the mold. After a short time, the molten metal filled within the cavity portion is cooled so as to be solidified, and thus the mold is thereafter opened, with the result that a product is formed.

Patent Document 1: Japanese Patent No. 2605054

DISCLOSURE OF THE INVENTION

Problems to be Solved by the Invention

Incidentally, in order to reduce the entry of a foreign substrate included in the molten metal into the cavity portion, a filter is provided within the sprue portion. Preferably, this filter is originally removed from the mold together with the product when the mold is opened and thus the product within the cavity portion is removed. However, when in order to reduce a cycle time in casting, a solidification time after the casting is reduced, the filter which needs to be removed from the mold together with the product may be left within the sprue portion. More specifically, when the pressure within the furnace is opened with timing at which the molten metal within the cavity portion is solidified, the mold is opened and thus the product within the cavity portion is removed, the molten metal within the sprue portion is not sufficiently cooled so as to be solidified at this time, and thus the filter is separated from the product portion by incomplete solidification of the sprue portion, with the result that the filter may be left within the sprue portion as described above.

When the filter is left within the sprue portion, since it is impossible to start the subsequent casting step using the same stalk, the same sprue portion and the same mold unless an operator performs an operation of removing this filter from the sprue portion, with the result that it is likely that the cycle time is extended and that hence productivity is lowered.

An object of the present invention is to provide a casting device which can manufacture a product in a short cycle time and a casting method using such a casting device.

Means for Solving the Problems (1) A casting device (for example, a casting device 1 which will be described later) according to the present invention includes: a furnace (for example, a pressurized furnace 2 which will be described later) which stores molten metal; a mold (for example, a mold 3 which will be described later) within which a cavity portion (for example, a cavity portion 33 which will be described later) is formed; a cylindrical stalk portion (for example, a stalk portion 6 which will be described later) which is provided in the furnace; a molten metal supply device (for example, a molten metal supply device 21 which will be described later) which supplies the molten metal within the furnace to the stalk portion; at least one sprue portion (for example, a first sprue portion 7 and a second sprue portion 8 which will be described later) which is a cylindrical member that connects an end portion of the stalk portion on a downstream side in a molten metal filling direction and the cavity portion and which guides the molten metal supplied to the stalk portion into the cavity portion; and a filter member (for example, a filter member 76 which will be described later) which is provided in the sprue portion, the filter member includes a flange portion (for example, a flange portion 762 which will be described later) which is extended along a direction of extension of the sprue portion and which abuts on an abutting portion (for example, a middle insert 74 which will be described later) of an inner wall surface of the sprue portion and in the vicinity of the abutting portion, a cooling passage (for example, a cooling passage 77 which will be described later) within which a coolant flows is provided.

(2) Preferably, in this case, the sprue portion is formed by combination of an upstream insert (for example, a lower insert 75 which will be described later) and a downstream insert (for example, an upper insert 73 and a middle insert 74 which will be described later), the upstream insert is a cylindrical member which forms a portion of the sprue portion on the side of the stalk portion from an end portion of the abutting portion on an upstream side in the molten metal filling direction, the downstream insert is a cylindrical member which forms a portion of the sprue portion on the side of the cavity portion from the end portion of the abutting portion on the upstream side in the molten metal filling direction and the cooling passage is formed in the downstream insert.

(3) Preferably, in this case, the sprue portion is provided by being inserted into a through hole (for example, a first through hole 34 and a second through hole 35 which will be described later) formed in the mold such that an end portion of the downstream insert on the downstream side in the molten metal filling direction communicates with the cavity portion, and in cross-sectional view of the sprue portion along the molten metal filling direction, a distance from an inner wall surface (for example, inner wall surfaces 731 and 741 which will be described later) of the downstream insert to an inner wall surface (for example, inner wall surfaces 34*a* and 34*b* which will be described later) of the through hole is shorter than a distance from an inner wall surface (for example, an inner wall surface 751 which will be described later) of the upstream insert to the inner wall surface (for example, an inner wall surface 34*c* which will be described later) of the through hole.

(4) Preferably, in this case, the downstream insert is formed by combination of a first downstream insert (for example, a middle insert 74 which will be described later) which is a cylindrical member and which includes the abutting portion and a second downstream insert (for example, an upper insert 73 which will be described later) which is a cylindrical member and which forms a portion of the downstream insert on the side of the cavity portion with respect to the first downstream insert, and the first downstream insert is formed of a material whose thermal conductivity is higher than the second downstream insert.

(5) Preferably, in this case, the sprue portion is provided by being inserted into a through hole (for example, a first through hole 34 and a second through hole 35 which will be described later) formed in the mold such that an end portion of the downstream insert on the downstream side in the molten metal filling direction communicates with the interior of the cavity portion, and a thermal insulation portion (for example, an void portion 755 which will be described later) is formed between an outer wall surface (for example, an outer wall surface 752 which will be described later) of the upstream insert and an inner wall surface (for example, an inner wall surface 34*c* which will be described later) of the through hole.

(6) Preferably, in this case, the thermal insulation portion is a void which is formed between the outer wall surface of the upstream insert and the inner wall surface of the through hole.

(7) A casting method according to the present invention uses a casting device (for example, a casting device 1 which will be described later) that includes: a furnace (for example, a pressurized furnace 2 which will be described later) which stores molten metal; a mold (for example, a mold 3 which will be described later) within which a cavity portion (for example, a cavity portion 33 which will be described later) is formed; a cylindrical stalk portion (for example, a stalk portion 6 which will be described later) which is provided in the furnace; a molten metal supply device (for example, a molten metal supply device 21 which will be described later) which increases a pressure within the furnace so as to supply the molten metal within the furnace to the stalk portion; at least one sprue portion (for example, a first sprue portion 7 and a second sprue portion 8 which will be described later) which is a cylindrical portion connecting an end portion of the stalk portion on a downstream side in a molten metal filling direction and the cavity portion and which guides the molten metal supplied to the stalk portion into the cavity portion; and a filter member (for example, a filter member 76 which will be described later) which is provided in the sprue portion, and that has the sprue portion formed by combination of a downstream sprue portion (for example, an upper insert 73 and a middle insert 74 which will be described later) in which the filter member is provided and which forms a downstream side of the sprue portion in the molten metal filling direction and an upstream sprue portion (for example, a lower insert 75 which will be described later) which forms an upstream side of the sprue portion in the molten metal filling direction with respect to the downstream sprue portion. The casting method includes: a first step (for example, step S1 of FIG. 8 which will be described later) of increasing the pressure within the furnace with the molten metal supply device so as to fill the molten metal into the cavity portion and thereafter maintaining the pressure within the furnace; a second step (for example, step S3 of FIG. 8 which will be described later) of cooling the downstream sprue portion according to the temperature of the molten metal within the cavity portion being lowered to a solid phase temperature; and a third step (for example, step S4 of FIG. 8 which will be described later) of reducing the pressure within the furnace after the temperature of the molten metal within the downstream sprue portion is lowered to the solid phase temperature and before the temperature of the molten metal within the upstream sprue portion is lowered to the solid phase temperature.

(8) Preferably, in this case, the second step includes at least any one of a step of making a coolant flow through a cooling passage formed in the downstream sprue portion and a step of increasing the pressure within the furnace as compared with the pressure in the first step.

(9) A casting device according to the present invention includes: a furnace which stores molten metal; a mold within which a cavity portion is formed; a base which supports the mold; a cylindrical stalk portion which is provided in the furnace; a platen within which a stalk chamber where the stalk portion is provided is provided; a molten metal supply device which increases a pressure within the furnace so as to supply the molten metal within the furnace to the stalk portion; at least one sprue portion which is a cylindrical member that connects an end portion of the stalk portion on a downstream side in a molten metal filling direction and the cavity portion and which guides the molten metal supplied to the stalk portion into the cavity portion; and a cooling means which cools the mold, the cooling means includes: a cooling member in which a coolant flow path where a coolant flows is formed; and a coolant pipe which is connected to the cooling member so as to supply the coolant to the coolant flow path, a space portion is formed between the bottom of the mold and the base, the cooling member is provided so as to be freely inserted and removed into and from the mold and the coolant pipe is provided in the space portion.

(10) Preferably, in this case, in the mold, a concave recessed portion is formed which is extended to the vicinity of a cavity surface forming a part of the cavity portion, the cooling member includes: a cooling insert which is inserted into the recessed portion; and a locating member which presses the cooling insert along the direction of the insertion thereof so as to locate the position of the cooling insert within the recessed portion and the cooling insert and the locating member include inclined surfaces which make sliding contact with each other and which are inclined with respect to the direction of the insertion.

Effects of the Invention (1) In the casting device of the present invention, the filter member for removal of a foreign substance is provided in the sprue portion which connects the stalk portion provided in the furnace and the cavity portion formed within the mold. In the filter member, the flange portion is provided which is extended along the direction of extension of the sprue portion and which abuts on the inner wall surface of the sprue portion. In the vicinity of the inner wall surface on which at least the flange portion of the filter member of the sprue portion abuts, the cooling passage within which the coolant flows is formed. Hence, in the present invention, in the molten metal filled within the sprue portion, the solidification of the molten metal in the part including the abutting portion on which the flange portion of the filter member abuts is accelerated. Hence, when the mold is opened, the sprue design portion including the filter member can be removed together with the product design portion molded by the solidification of the molten metal within the cavity portion. Therefore, in the present invention, after the mold is opened, the filter member is prevented from being left within the sprue portion, and thus it is possible to start, with the same stalk portion, the same sprue portion and the same mold, the subsequent casting step without performing an operation of removing the filter member from the sprue portion, and it is further possible to reduce the time in which the sprue portion is solidified, with the result that it is possible to reduce the cycle time.

In the present invention, in the vicinity of the inner wall surface of the abutting portion with which the flange portion of the filter member is in contact, the cooling passage through which the coolant flows is formed. In the present invention, the cooling passage is formed in such a position, and thus it is possible to maintain directional solidification in which the sprue portion is solidified after the solidification of the cavity portion, and hence the riser molten metal function of supplying the pressurized molten metal within the sprue portion corresponding to the solidification and contraction of the product within the cavity portion is achieved, with the result that the quality of the product can be maintained. When at the same time, the product is solidified, and thus it is not necessary to supply the riser molten metal, the abutting portion of the sprue portions is immediately actively cooled, and thus it is possible to accelerate the solidification of the sprue portion, with the result that it is possible to prevent the filter from being left in the mold while it is possible to reduce the cycle time after the solidification of the product until the opening of the mold.

(2) In the present invention, the sprue portion is formed by combination of the upstream insert and the downstream insert. The downstream insert is a cylindrical member which forms a portion of the sprue portion on the side of the cavity portion from the end portion of the abutting portion on the upstream side in the molten metal filling direction, and in the downstream insert, the cooling passage through which the coolant flows is formed. In this way, in the molten metal filled in the sprue portion, the cooling rate in the part covered with the downstream insert can be increased as compared with the cooling rate in the part covered with the upstream insert, with the result that it is possible to reduce the time necessary for the opening of the mold and to prevent the filter member from being left within the downstream insert.

(3) In the present invention, the sprue portion is inserted into the through hole formed in the mold such that the end portion of the downstream insert on the downstream side in the molten metal filling direction communicates with the interior of the cavity portion. In cross-sectional view of the sprue portion along the direction of the flow of the molten metal, the distance from the inner wall surface of the downstream insert to the inner wall surface of the through hole is set shorter than the distance from the inner wall surface of the upstream insert to the inner wall surface of the through hole. In this way, as compared with the upstream insert, in the downstream insert, the cooling rate caused by heat drawing from the mold can be increased. Hence, in the present invention, in the molten metal filled in the sprue portion, the cooling rate in the part covered with the downstream insert can be increased as compared with the cooling rate in the part covered with the upstream insert, with the result that it is possible to reduce the time necessary for the opening of the mold and to prevent the filter member from being left within the downstream insert.

(4) In the present invention, the downstream insert is formed by combination of the first downstream insert which is the portion including the abutting portion and the second downstream insert which forms a portion of the downstream insert on the side of the cavity portion with respect to the first downstream insert. In the present invention, the first downstream insert which is the portion including the abutting portion is formed of the material whose thermal conductivity is higher than that of the second downstream insert. Since the molten metal filled within the cavity portion is contracted in the process of being cooled within the mold, in order to prevent the occurrence of a shrinkage cavity in the product, it is necessary to supply the riser molten metal corresponding to the contraction to the cavity portion. Hence, in the present invention, as described above, the cooling rate in the second downstream insert which is closer to the cavity portion than the first downstream insert is decreased as compared with the cooling rate in the first downstream insert. In this way, while the cooling rate in the first downstream insert is being increased, it is possible to supply, as the riser molten metal, the molten metal filled within the second downstream insert into the cavity portion. Hence, while the cycle time is being reduced, a good product free from a shrinkage cavity can be manufactured.

(5) In the present invention, the sprue portion is inserted into the through hole formed in the mold such that the end portion of the downstream insert on the downstream side in the molten metal filling direction communicates with the cavity portion. In the present invention, the thermal insulation portion is formed between the outer wall surface of the upstream insert which is the portion that does not include the abutting portion and the inner wall surface of the through hole. In this way, the cooling rate of the molten metal in the part covered with the upstream insert can be decreased as compared with the cooling rate of the molten metal in the part covered with the downstream insert, and thus the maximum amount of molten metal which is returned from the sprue portion into the furnace can be acquired, with the result that the cost of the material can be reduced.

(6) In the present invention, the thermal insulation portion is the void which is formed between the outer wall surface of the upstream insert and the inner wall surface of the through hole in the mold. In this way, without use of a special material, with a simple configuration, as described above, the maximum amount of molten metal which is returned from the sprue portion into the furnace can be acquired, with the result that the cost of the material can be reduced.

(7) In the casting method of the present invention, the pressure within the furnace is increased, thus the molten metal is filled into the cavity portion and thereafter the pressure within the furnace is maintained. Thereafter, in the present invention, after the temperature of the molten metal within the cavity portion is lowered to the solid phase temperature, the downstream sprue portion is cooled. In this way, until the molten metal within the cavity portion is solidified and thus the riser molten metal is not needed, the molten metal within the downstream sprue portion can be maintained, with the result that the riser molten metal can be acquired so as to prevent the occurrence of a shrinkage cavity in the product. In the present invention, the pressure within the furnace is reduced after the temperature of the molten metal within the downstream sprue portion is lowered to the solid phase temperature and before the temperature of the molten metal within the upstream sprue portion is lowered to the solid phase temperature. As described above, in the present invention, the solidification of the molten metal within the downstream sprue portion which is the portion of the sprue portion including the filter member proceeds to a certain degree, and the pressure within the furnace is reduced in a state where the molten metal within the upstream sprue portion is in a liquid phase, with the result that when the mold is opened, the sprue design portion including the filter member can be removed together with the product design portion formed by the solidification of the molten metal within the cavity portion. Hence, in the present invention, after the mold is opened, the filter member is prevented from being left within the sprue portion, and thus it is possible to start, with the same stalk portion, the same sprue portion and the same mold, the subsequent manufacturing step without performing an operation of removing the filter member from the sprue portion, with the result that it is possible to reduce the cycle time. In the state where the molten metal within the upstream sprue portion is in the liquid phase, the pressure within the furnace is reduced, thus the molten metal within the upstream sprue portion can be returned into the furnace and hence it is possible to reduce an increase in the size of the sprue design portion, with the result that the cost of the material can be reduced.

(8) In the present invention, in the second step, at least any one of the step of making the coolant flow through the cooling passage formed in the downstream sprue portion and the step of increasing the pressure within the furnace as compared with the pressure in the first step is performed. In this way, in the second step, the temperature of the molten metal within the downstream sprue portion can be rapidly lowered to the solid phase temperature, and thus the third step can be rapidly started, with the result that it is possible to further reduce the cycle time.

(9) In the present invention, the space portion is formed between the mold and the base which supports the mold. In the present invention, the cooling member of the cooling means for cooling the mold is provided so as to be freely inserted and removed into and from the mold, and the cooling pipe for the cooling member is further provided in the space portion between the mold and the base. In this way, it is possible to cool only an arbitrary portion within the mold which needs to be cooled. In this way, it is also possible to perform cooling control on a high-precision product portion and to cool the wall thickness portion of the mold and a complex structure portion, with the result that it is possible to prevent galling and damage caused by the heat of the mold.

(10) In the present invention, the cooling member is formed with: the cooling insert which is inserted into the recessed portion formed in the mold; and the locating member which presses the cooling insert along the direction of the insertion so as to locate the position of the cooling insert within the recessed portion. The surfaces of the cooling insert and the locating member which make sliding contact with each other are set to the inclined surfaces which are inclined with respect to the direction of the insertion. Hence, in the present invention, the cooling insert inserted into the recessed portion of the mold is pressed with the locating member along the direction of the insertion, and thus the cooling insert is made to slide in the vertical direction with respect to the direction of the insertion, with the result that the position within the recessed portion can be determined. In this way, the position of the cooling insert within the recessed portion can be brought close to a part of the interior of the mold which is required to be cooled or can be separated from a part which is not required to be cooled, and thus it is possible to perform higher-precision cooling control, with the result that it is possible to increase the life of the mold and to prevent galling with the product.

PREFERRED MODE FOR CARRYING OUT THE INVENTION

Figure 1:
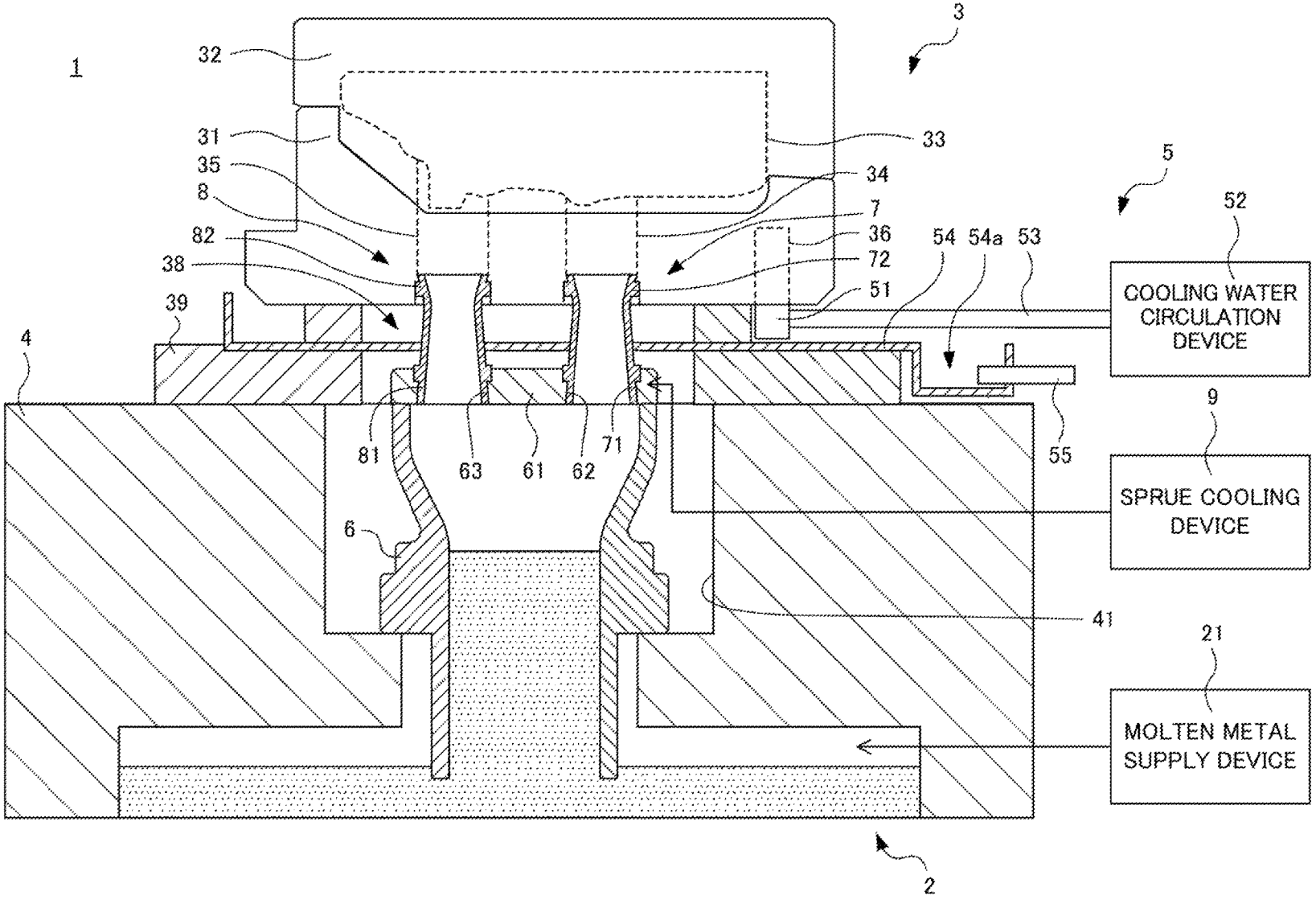
FIG. 1 is a diagram showing the configuration of a casting device according to an embodiment of the present invention.

An embodiment of the present invention will be described below with reference to drawings. FIG. 1 is a diagram showing the configuration of a casting device 1 according to the present embodiment. The casting device 1 is used when a cast product is molded based on a so-called low pressure casting method. Although in the following description, the cast product is assumed to be a cylinder head in an engine, the present invention is not limited to this assumption.

The casting device 1 includes: a pressurized furnace 2 which stores molten metal (for example, aluminum); a mold 3 within which a cavity portion 33 is formed; a platen 4 which is provided on the upper side of the pressurized furnace 2 in a vertical direction; a base 39 which is installed on the platen 4 so as to support the mold 3; a mold cooling device 5 which cools the mold 3; a cylindrical stalk portion 6 which is provided in a stalk chamber 41 formed within the platen 4 and which is extended along the vertical direction; a molten metal supply device 21 which supplies, into the stalk portion 6, the molten metal stored within the pressurized furnace 2; a plurality of sprue portions (in the example of FIG. 1, two sprue portions) serving as a first sprue portion 7 and a second sprue portion 8 which are cylindrical members for connecting an end portion of the stalk portion 6 on the upper side in the vertical direction and the cavity portion 33 and which guide the molten metal supplied to the stalk portion 6 into the cavity portion 33; and a sprue cooling device 9 which cools these sprue portions 7 and 8. Although in the present embodiment, a case where the number of sprue portions is set to two is described, the number of sprue portions is not limited to two.

The mold 3 is formed by combination of a lower mold 31 which is a fixed mold and an upper mold 32 which is provided so as to be freely moved forward and backward with an unillustrated slide cylinder with respect to the lower mold 31 and which is a movable mold. When the upper mold 32 and the lower mold 31 are moved close to each other, as shown in FIG. 1, between the lower mold 31 and the upper mold 32, the cavity portion 33 is formed which serves as a space where the shape of the product is formed. The mold 3 is supported by the base 39 so as to be located on the upper side of the pressurized furnace 2 in the vertical direction. There is no limitation on the configuration of the mold 3 described above. The mold 3 may include not only the fixed mold and the movable mold arranged in the vertical direction as described above but also a slide mold which can laterally slide with a slide mechanism so as to move close to and away from them.

The molten metal supply device 21 supplies air into the pressurized furnace 2, increases, with the air, the pressure within the pressurized furnace 2 and thereby pushes up the molten metal stored within the pressurized furnace 2 along the vertical direction so as to supply the molten metal into the stalk portion 6, the sprue portions 7 and 8 and cavity portion 33. The molten metal supply device 21 removes the air within the pressurized furnace 2 to the outside, and thereby decreases the pressure within the pressurized furnace 2 so as to recover, into the pressurized furnace 2, the molten metal left within the stalk portion 6 and the sprue portions 7, 8.

Within the platen 4, the stalk chamber 41 is formed which serves as a cylindrical space that is extended along the vertical direction. The stalk portion 6 is cylindrical, and is extended from the interior of the pressurized furnace 2 to the side of the lower mold 31 along the vertical direction. At an end portion of the stalk portion 6 on a downstream side in a molten metal filling direction, a disc-shaped cover member 61 is provided. In the cover member 61, the same number of through holes 62 and 63 as the number of sprue portions 7 and 8 are formed.

The first sprue portion 7 and the second sprue portion 8 each are cylindrical members which are extended along the vertical direction, and make the end portion of the stalk portion 6 on the downstream side in the molten metal filling direction and the cavity portion 33 formed within the mold 3 communicate with each other. An end portion 71 of the first sprue portion 7 on an upstream side in the molten metal filling direction is inserted into the first through hole 62 of the stalk portion 6, and an end portion 72 of the first sprue portion 7 on the downstream side in the molten metal filling direction is inserted into a first through hole 34 formed in the lower mold 31. An end portion 81 of the second sprue portion 8 on the upstream side in the molten metal filling direction is inserted into the second through hole 63 of the stalk portion 6, and an end portion 82 of the second sprue portion 8 on the downstream side in the molten metal filling direction is inserted into a second through hole 35 formed in the lower mold 31.

Figure 2:
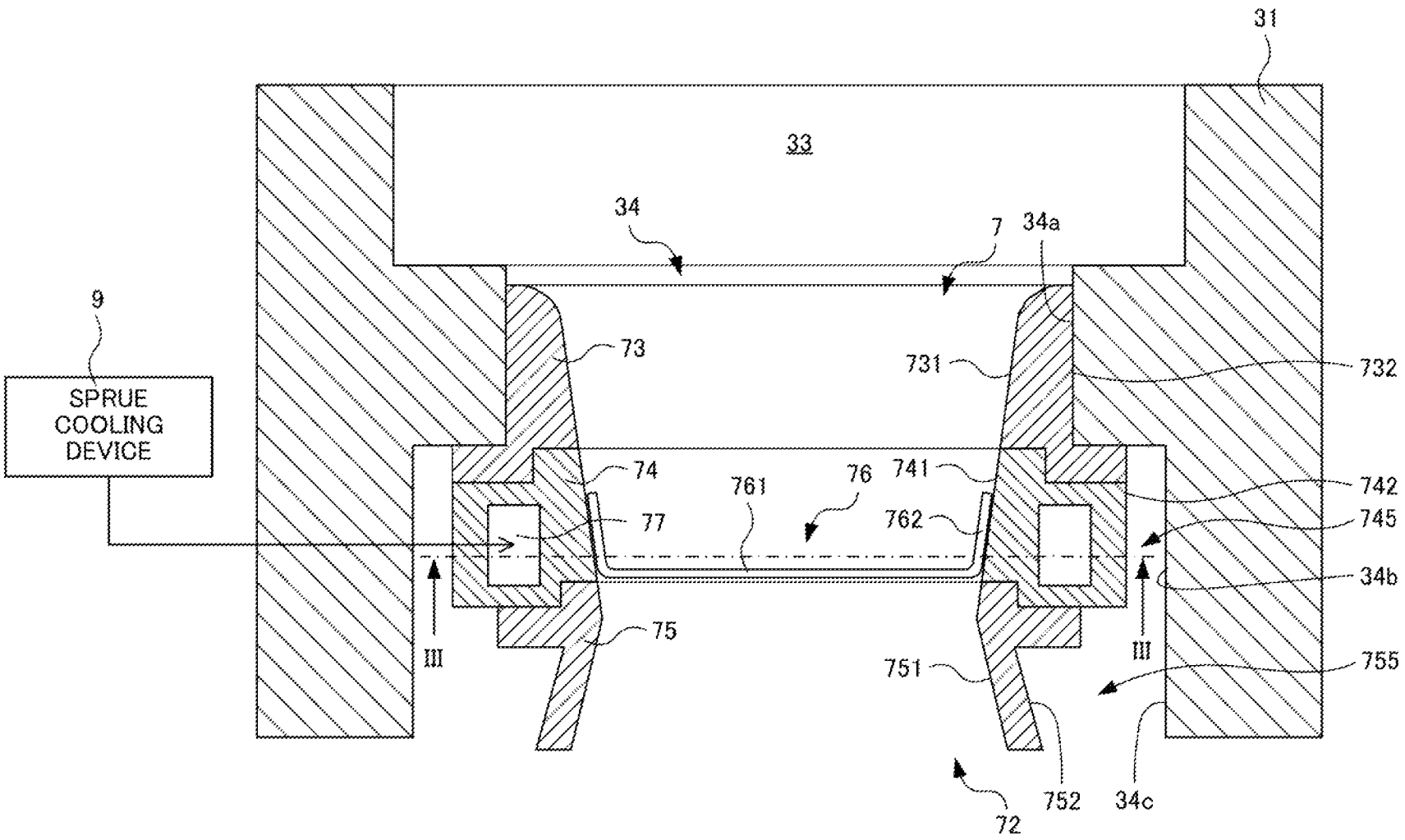
FIG. 2 is a cross-sectional view of an end portion of a first sprue portion on a downstream side in a molten metal filling direction.

FIG. 2 is a cross-sectional view of the end portion 72 of the first sprue portion 7 on the downstream side in the molten metal filling direction and the first through hole 34 of the lower mold 31 into which the end portion 72 is inserted. The configuration of the end portion 82 of the second sprue portion 8 on the downstream side in the molten metal filling direction and the second through hole 35 of the lower mold 31 is substantially the same as that of the end portion 72 of the first sprue portion 7 and the first through hole 34, and thus the illustration and the detailed description thereof will be omitted.

As shown in FIG. 2, the first sprue portion 7 is formed by combination of three inserts 73, 74 and 75. More specifically, the first sprue portion 7 is formed by connecting the upper insert 73, the middle insert 74 and the lower insert 75 which are cylindrical members from the downstream side toward the upstream side in the molten metal filling direction in this order. Within the first sprue portion 7, a filter member 76 is provided which prevents the entry of a foreign substance in the molten metal into the side of the cavity portion 33.

These inserts 73, 74 and 75 are provided by being inserted into the first through hole 34 formed in the lower mold 31 such that the upper insert 73 communicates with the interior of the cavity portion 33.

The upper insert 73 is a cylindrical member which forms the end portion of the first sprue portion 7 on the downstream side in the molten metal filling direction. The inner wall surface 731 of the upper insert 73 is tapered such that the diameter thereof is increased from the upstream side toward the downstream side in the molten metal filling direction. The upper insert 73 is provided within the first through hole 34 such that the outer wall surface 732 thereof is brought into intimate contact with the inner wall surface 34*a* of the first through hole 34. The upper insert 73 is formed of, for example, tungsten.

The middle insert 74 is a cylindrical member which connects the upper insert 73 and the lower insert 75. The inner wall surface 741 of the middle insert 74 is tapered such that the diameter thereof is increased from the upstream side toward the downstream side in the molten metal filling direction. When the middle insert 74 is coupled to the upper insert 73, the inner wall surface 741 of the middle insert 74 and the inner wall surface 731 of the upper insert 73 are flush with each other. As shown in FIG. 2, in a state where the middle insert 74 is coupled to the upper insert 73, between the outer wall surface 742 of the middle insert 74 and the inner wall surface 34*b* of the first through hole 34, a void portion 745 is formed.

In the middle insert 74, a cooling passage 77 is formed which covers at least a part of the entire circumference of the inner wall surface 741. The sprue cooling device 9 circulates a coolant within the cooling passage 77 of the middle insert 74 so as to mainly cool the middle insert 74 in particular of the first sprue portion 7. Here, specific examples of the coolant include an air flow, a mist flow, cooling water and the like, and an air flow is particularly preferable. The middle insert 74 is formed of a material whose thermal conductivity is higher than those of the materials of the upper insert 73 and the lower insert 75, and more specifically, the middle insert 74 is formed of tungsten. In the present embodiment, the cooling passage 77 is formed in the middle insert 74, furthermore, the middle insert 74 is formed of the material whose thermal conductivity is high and thus in a state where the molten metal is filled in the first sprue portion 7, the cooling rate of the molten metal in the part covered with the middle insert 74 can be increased as compared with the cooling rate of the molten metal in the part covered with the lower insert 75 on the upstream side with respect to the middle insert 74.

Figure 3A:
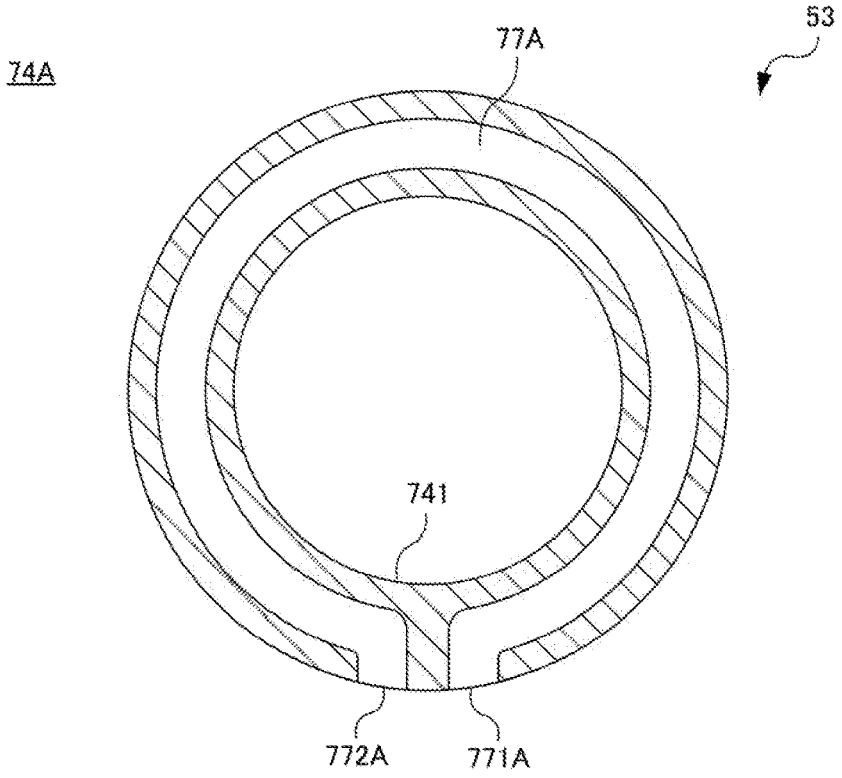
FIG. 3A is a diagram showing the configuration of the middle insert of a first example.
Figure 3B:
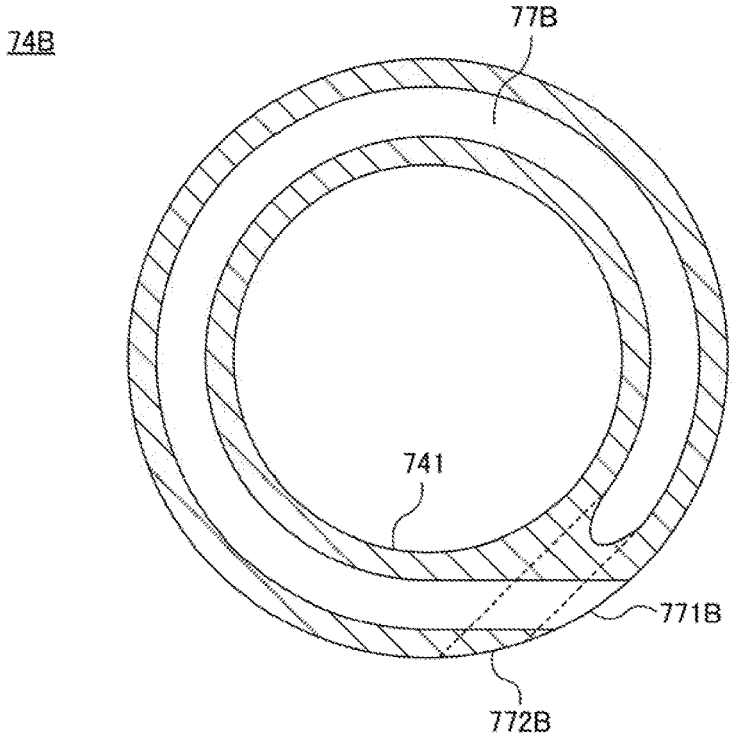
FIG. 3B is a diagram showing the configuration of the middle insert of a second example.
Figure 3C:
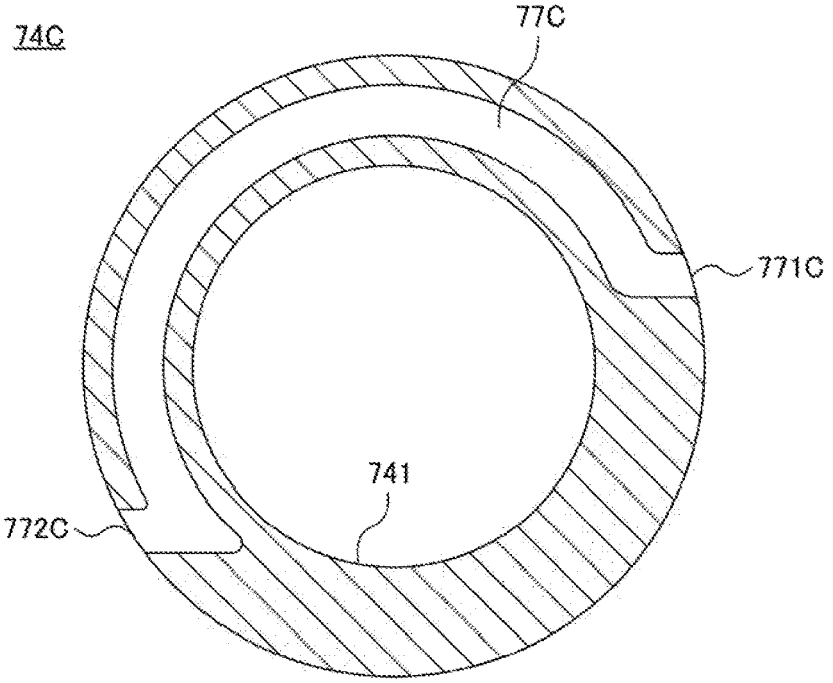
FIG. 3C is a diagram showing the configuration of the middle insert of a third example.
Figure 3D:
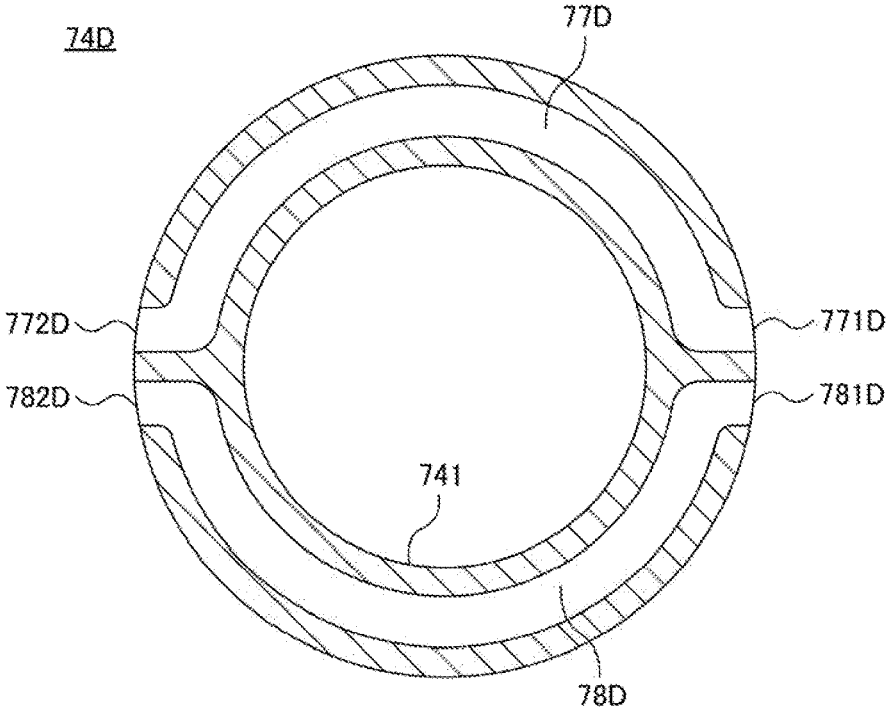
FIG. 3D is a diagram showing the configuration of the middle insert of a fourth example.
Figure 3E:
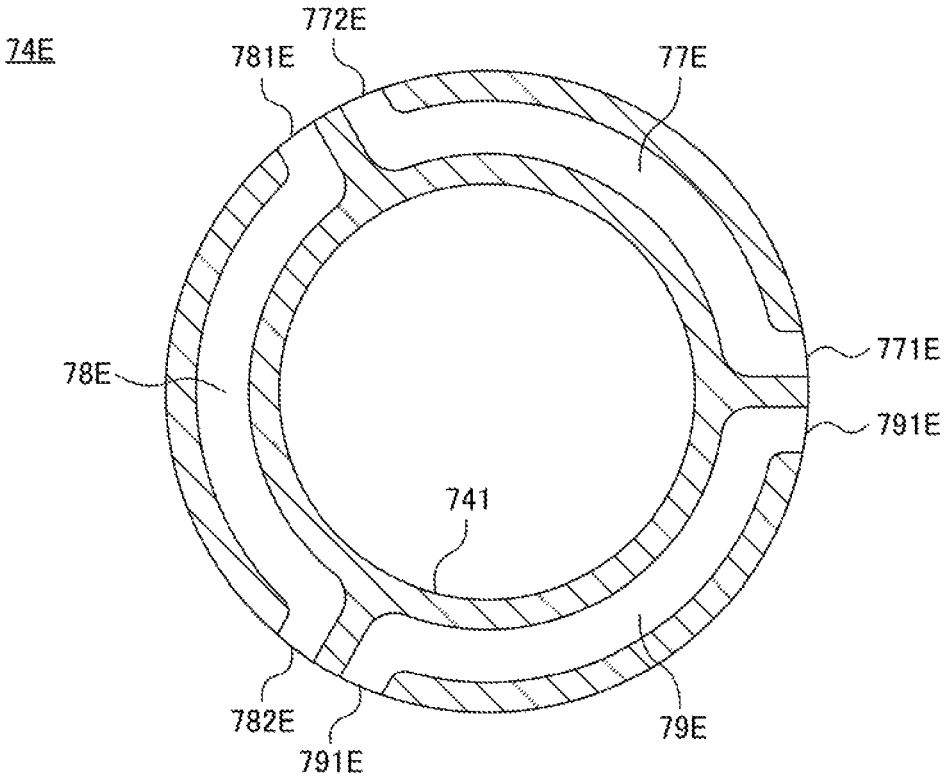
FIG. 3E is a diagram showing the configuration of the middle insert of a fifth example.

Specific examples of the configuration of the cooling passage will then be described with reference to the cross-sectional views of FIGS. 3A to 3E. FIGS. 3A to 3E are cross-sectional views of middle inserts along line III-III of FIG. 2. More specifically, FIG. 3A is a diagram showing the configuration of the middle insert 74A of a first example, FIG. 3B is a diagram showing the configuration of the middle insert 74B of a second example, FIG. 3C is a diagram showing the configuration of the middle insert 74C of a third example, FIG. 3D is a diagram showing the configuration of the middle insert 74D of a fourth example and FIG. 3E is a diagram showing the configuration of the middle insert 74E of a fifth example.

As shown in FIG. 3A, a cooling passage 77A formed in the middle insert 74A of the first example is in the shape of the letter C in cross-sectional view. In one end surface of the outer circumferential surface of the middle insert 74A, a coolant inlet 771A and a coolant outlet 772A are formed side by side. The cooling passage 77A is extended counterclockwise in the shape of an arc from the coolant inlet 771A along the inner wall surface 741 and reaches the coolant outlet 772A. The sprue cooling device 9 supplies the coolant to the coolant inlet 771A and recovers the coolant discharged from the coolant outlet 772A so as to circulate the coolant within the cooling passage 77A. With the middle insert 74A of the first example, the cooling passage 77A covers substantially the entire circumference of the inner wall surface 741 so as to be able to efficiently cool the molten metal in the part covered with the middle insert 74A.

As shown in FIG. 3B, a cooling passage 77B formed in the middle insert 74B of the second example is in the shape of a spiral in cross-sectional view. In one end surface of the outer circumferential surface of the middle insert 74B, a coolant inlet 771B and a coolant outlet 772B are formed side by side. Although in FIG. 3B, a case where the coolant inlet 771B is formed on the front side along the plane of the figure with respect to the coolant outlet 772B is shown, the opposite case may be adopted. The cooling passage 77B is extended clockwise in the shape of an arc from the coolant inlet 771B along the inner wall surface 741 and reaches the coolant outlet 772B. The sprue cooling device 9 supplies the coolant to the coolant inlet 771B and recovers the coolant discharged from the coolant outlet 772B so as to circulate the coolant within the cooling passage 77B. With the middle insert 74B of the second example, the cooling passage 77B covers the entire circumference of the inner wall surface 741 so as to be able to efficiently cool the molten metal in the part covered with the middle insert 74B as compared with the middle insert 74A of the first example described above.

As shown in FIG. 3C, a cooling passage 77C formed in the middle insert 74C of the third example is in the shape of the letter C in cross-sectional view. In one end surface of the outer circumferential surface of the middle insert 74C, a coolant inlet 771C is formed, and in the other end surface, a coolant inlet 772C is formed. The cooling passage 77C is extended counterclockwise in the shape of an arc from the coolant inlet 771C along the inner wall surface 741 and reaches the coolant outlet 772C. The sprue cooling device 9 supplies the coolant to the coolant inlet 771C and recovers the coolant discharged from the coolant outlet 772C so as to circulate the coolant within the cooling passage 77C. With the middle insert 74C of the third example, the cooling passage 77C covers only substantially half the circumference of the inner wall surface 741, and thus as compared with the middle inserts 74A and 74B of the first and second examples described above, the overall cooling efficiency is lowered. However, there is an advantage in that it is possible to efficiently cool the molten metal in only a part where solidification is desired to be accelerated in particular of the molten metal covered with the middle insert 74C.

As shown in FIG. 3D, in the middle insert 74D of the fourth example, the total two cooling passages which are a first cooling passage 77D and a second cooling passage 78D are formed. The cooling passages 77D and 78D each are in the shape of the letter C in cross-sectional view. In one end surface of the outer circumferential surface of the middle insert 74D, a first coolant inlet 771D and a second coolant inlet 781D are formed side by side, and in the other end surface, a first coolant outlet 772D and a second coolant outlet 782D are formed side by side. The first cooling passage 77D is extended counterclockwise in the shape of an arc from the first coolant inlet 771D along the inner wall surface 741 and reaches the first coolant outlet 772D. The second cooling passage 78D is extended clockwise in the shape of an arc from the second coolant inlet 781D along the inner wall surface 741 and reaches the second coolant outlet 782D. The sprue cooling device 9 supplies the coolant to the first coolant inlet 771D and the second coolant inlet 781D and recovers the coolant discharged from the first coolant outlet 772D and the second coolant outlet 782D so as to circulate the coolant within the cooling passages 77D and 78D. With the middle insert 74D of the fourth example, the two cooling passages 77D and 78D cover substantially the entire circumference of the inner wall surface 741, and thus the cooling efficiency thereof is substantially the same as that of the middle insert 74A of the first example described above. With the middle insert 74D of the fourth example, the flow rates of the coolant in the two cooling passages 77D and 78D can be made different from each other, and thus the cooling efficiency can be partially made different.

As shown in FIG. 3E, in the middle insert 74E of the fifth example, the total three cooling passages which are a first cooling passage 77E, a second cooling passage 78E and a third cooling passage 79E are formed. The cooling passages 77E, 78E and 79E each are in the shape of the letter C in cross-sectional view. In the outer circumferential surface of the middle insert 74E, a first coolant inlet 771E, a first coolant outlet 772E, a second coolant inlet 781E, a second coolant outlet 782E, a third coolant inlet 791E and a third coolant outlet 792E are formed counterclockwise. The first coolant inlet 771E and the third coolant outlet 792E are formed side by side, the first coolant outlet 772E and the second coolant inlet 781E are formed side by side and the second coolant outlet 782E and the third coolant inlet 791E are formed side by side. The first coolant inlet 771E and the second coolant inlet 781E are formed such that an angle therebetween is about 120°, and the second coolant inlet 781E and the third coolant inlet 791E are formed such that an angle therebetween is about 120°. The first cooling passage 77E is extended counterclockwise in the shape of an arc from the first coolant inlet 771E along the inner wall surface 741 and reaches the first coolant outlet 772E. The second cooling passage 78E is extended counterclockwise in the shape of an arc from the second coolant inlet 781E along the inner wall surface 741 and reaches the second coolant outlet 782E. The third cooling passage 79E is extended counterclockwise in the shape of an arc from the third coolant inlet 791E along the inner wall surface 741 and reaches the third coolant outlet 792E. The sprue cooling device 9 supplies the coolant to the first coolant inlet 771E, the second coolant inlet 781E and the third coolant inlet 791E and recovers the coolant discharged from the first coolant outlet 772E, the second coolant outlet 782E and the third coolant outlet 792E so as to circulate the coolant within the cooling passages 77E, 78E and 79E. With the middle insert 74E of the fifth example, the three cooling passages 77E, 78E and 79E cover substantially the entire circumference of the inner wall surface 741, and thus the cooling efficiency thereof is substantially the same as that of the middle insert 74A of the first example described above. With the middle insert 74E of the fifth example, the flow rates of the coolant in the three cooling passages 77E, 78E and 79E can be made different from each other, and thus as compared with the middle insert 74D of the fourth example, the cooling efficiency can be finely and partially made different.

With reference back to FIG. 2, the lower insert 75 is a cylindrical member which forms an end portion of the first sprue portion 7 on the upstream side in the molten metal filling direction. The inner wall surface 751 of the lower insert 75 is tapered such that the diameter thereof is decreased from the upstream side toward the downstream side in the molten metal filling direction. When the lower insert 75 is coupled to the middle insert 74, the inner wall surface 751 of the lower insert 75 and the inner wall surface 741 of the middle insert 74 are flush with each other. The lower insert 75 is formed of, for example, tungsten.

As shown in FIG. 2, in a state where the lower insert 75 is coupled to the middle insert 74, between the outer wall surface 752 of the lower insert 75 and the inner wall surface 34*c* of the first through hole 34, a void portion 755 is formed.

As shown in FIG. 2, the void portion 755 formed between the lower insert 75 and the first through hole 34 is larger than the void portion 745 formed between the middle insert 74 and the first through hole 34.

As shown in FIG. 2, in cross-sectional view of the first sprue portion 74 along the direction of the flow of the molten metal, a distance from the inner wall surface 731 of the upper insert 73 to the inner wall surface 34*a* of the first through hole 34 and a distance from the inner wall surface 741 of the middle insert 74 to the inner wall surface 34*b* of the first through hole 34 are shorter than a distance from the inner wall surface 751 of the lower insert 75 to the inner wall surface 34*c* of the first through hole 34. As will be described later, the lower mold 31 is cooled with the mold cooling device 5. Hence, the distances from the inner wall surfaces 731, 741 and 751 of the inserts 73, 74 and 75 to the inner wall surfaces 34*a*, 34*b* and 34*c* of the first through hole 34 are set as described above, and thus the cooling rates of the upper insert 73 and the middle insert 74 caused by heat drawing from the lower mold 31 can be increased as compared with the cooling rate of the lower insert 75 caused by heat drawing from the lower mold 31.

The filter member 76 includes a disc-shaped wire mesh portion 761 and a flange portion 762 which is provided in the outer circumferential edge portion of the wire mesh portion 761. The foreign substance included in the molten metal supplied form the stalk portion 6 is removed with the wire mesh portion 761. The flange portion 762 is extended along the direction of extension of the first sprue portion 7. The flange portion 762 has a tapered shape which has the same taper angle as the inner wall surface 741 of the middle insert 74. The filter member 76 is provided in the middle insert 74 so as to make contact with only the inner wall surface 741 of the middle insert 74 among the three inserts 73, 74 and 75. In a state where the filter member 76 is provided in the middle insert 74, the flange portion 762 abuts on the inner wall surface 741 of the middle insert 74. In the present embodiment, the filter member 76 is provided so as to make contact with only the inner wall surface 741 of the middle insert 74, and thus in a state where the molten metal is filled in the first sprue portion 7, the cooling rate of the molten metal in the part covered with the middle insert 74 can be increased as compared with the cooling rate of the molten metal in the part covered with the lower insert 75 on the upstream side with respect to the middle insert 74.

Figure 4:
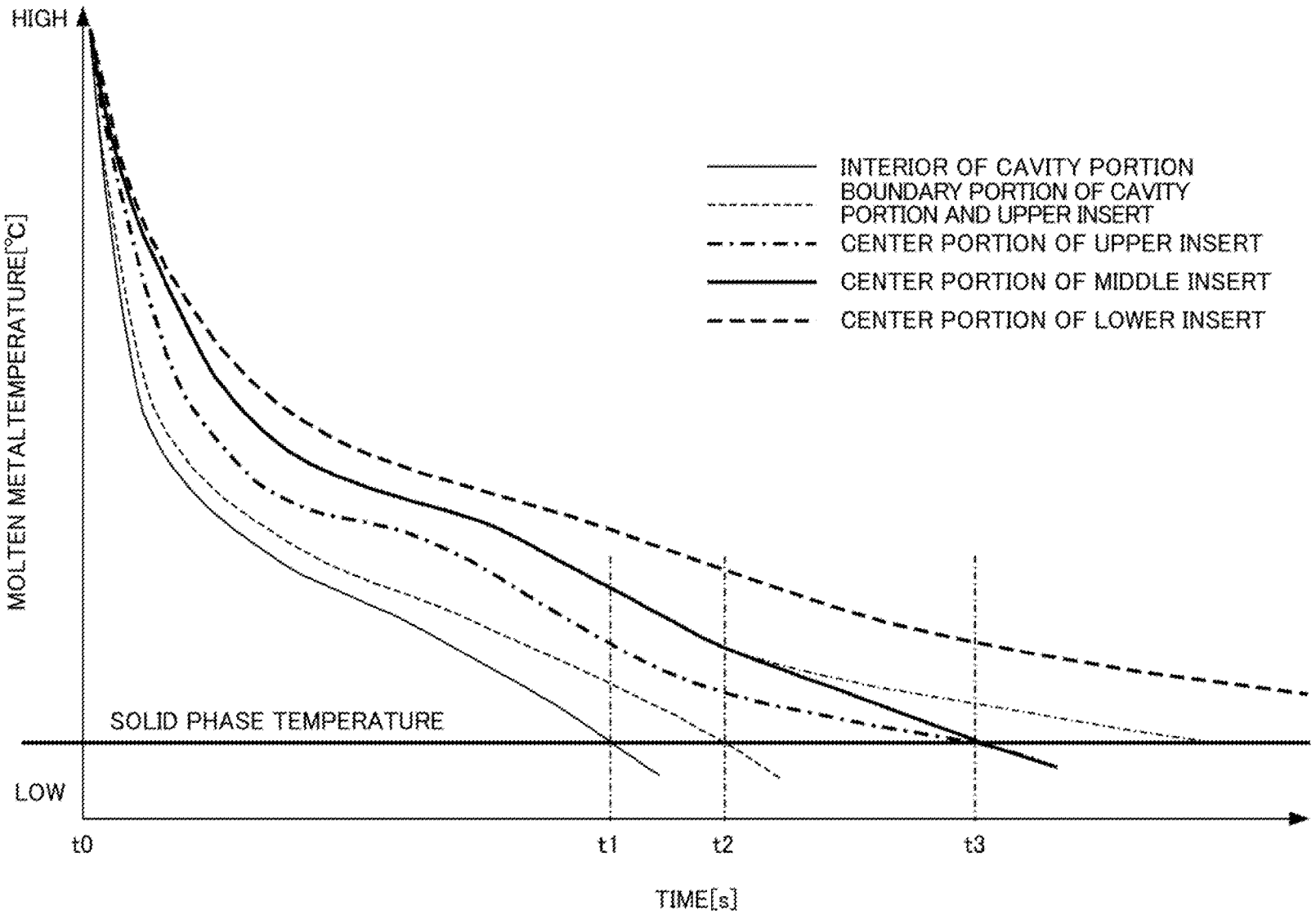
FIG. 4 is a diagram showing changes in the temperatures of individual portions realized when a cast product is molded according to the casting method of FIG. 8.

FIG. 4 is a diagram showing changes in the temperatures of individual portions realized when a cast product is molded according to the casting method of FIG. 8 which will be described later. In FIG. 4, changes in the temperatures of the molten metal in the five portions which are determined within the first sprue portion 7 and the cavity portion 33 are shown. More specifically, a thin solid line indicates changes in the temperature of the molten metal within the cavity portion 33, a thin broken line indicates changes in the temperature of the molten metal in a boundary portion of the cavity portion 33 and the upper insert 73, a thick alternate long and short dashed line indicates changes in the temperature of the molten metal in a center portion of the upper insert 73, a thick solid line indicates changes in the temperature of the molten metal in a center portion of the middle insert 74 and a thick broken line indicates changes in the temperature of the molten metal in a center portion of the lower insert 75.

The molten metal is first filled into the cavity portion 33, the sprue portions 7 and 8 and the stalk portion 6, and thereafter at time t0, the cooling of the mold 3 using the mold cooling device 5 is started. In this way, after time t0, the temperatures of the molten metal in the individual portions described above start to be lowered. Here, as shown in FIG. 4, the temperatures of the individual portions are lowered at such rates that the portions closer to the mold cooling device 5 are lowered at higher rates, that is, the interior of the cavity portion 33, the boundary portion of the cavity portion 33 and the upper insert 73, the center portion of the upper insert 73 and the center portion of the middle insert 74 and the center portion of the lower insert 75 are lowered at higher rates in this order.

Thereafter, at time t1, the temperature of the interior of the cavity portion 33 is lowered beyond a solid phase temperature, furthermore at time t2, the temperature of the boundary portion of the cavity portion 33 and the upper insert 73 is lowered beyond the solid phase temperature and accordingly, the sprue cooling device 9 starts to cool the middle insert 74. Here, until at time t2, the temperature of the boundary portion of the cavity portion 33 and the upper insert 73 is lowered beyond the solid phase temperature, the temperature of the center portion of the upper insert 73 is constantly higher than the temperature of the boundary portion of the cavity portion 33 and the upper insert 73. Hence, the molten metal within the upper insert 73 is supplied as riser molten metal into a gap which is formed as a result of the molten metal within the cavity portion 33 being cooled so as to be contracted.

When as described above, at time t2, the cooling of the middle insert 74 is started, among the cooling rates of the molten metal in the center portions of the inserts 73, 74 and 75, the cooling rate in the middle insert 74 is the highest. This is because cooling water is made to flow through the cooling passage 77 formed within the middle insert 74 and furthermore, the filter member 76 is provided within the middle insert 74. When the cooling water is not made to flow and the filter member 76 is not provided in the middle insert 74, the temperature of the molten metal in the center portion of the middle insert 74 is slowly lowered as indicated by a thin alternate long and short dashed line in FIG. 4.

Thereafter, at time t3, the molten metal in the center portion of the upper insert 73 and the molten metal in the center portion of the middle insert 74 are lowered beyond the solid phase temperature substantially at the same time. Here, as shown in FIG. 4, the temperature of the molten metal in the center portion of the lower insert 75 is higher than the solid phase temperature. Hence, after time t3 and before the temperature of the molten metal in the center portion of the lower insert 75 becomes equal to or less than the solid phase temperature, the pressure within the pressurized furnace 2 is reduced, and thus both the molten metal filled in the stalk portion 6 and the molten metal in the lower insert 75 can be recovered into the pressurized furnace 2. In the present embodiment, after the temperature of the molten metal in the center portion of the middle insert 74 is lowered beyond the solid phase temperature, the pressure of the pressurized furnace 2 is reduced, and thus when the mold is opened, the filter member 76 provided within the middle insert 74 can be removed together with a sprue design portion.

With reference back to FIG. 1, the configuration of the mold cooling device 5 will then be described. In a casting device, a casting cycle is repeated in which high-temperature molten metal is injected into a mold, in which cooling is performed until the molten metal in a cavity portion enters a solid phase and in which a product is thereafter removed. Hence, in the casting device, various cooling mechanisms for cooling the mold are provided. In a conventional cooling mechanism, a coolant is often made to flow into a cooling hole formed within a mold so as to cool the mold. However, when the cooling hole is formed within the mold, the cooling hole needs to be formed while an insert, a core and the like are being avoided. Since the cooling hole is basically formed with a cutting tool such as a drill, a cooing hole having a complicated channel cannot be formed, and thus it is not always possible to form a cooling hole in a position close to a portion in which the heat of the mold builds up. Moreover, since the cooling hole is formed as a long hole such as a drill hole, it is difficult to cool only a portion which is desired to be cooled. The mold cooling device 5 according to the present embodiment is provided in view of the problems as described above.

The mold cooling device 5 according to the present embodiment is provided by utilization of a space portion 38 formed between the lower mold 31 and the base 39. The mold cooling device 5 includes: a cooling cartridge 51 that is provided so as to be freely inserted and removed into and from a cooling slot 36 which is formed in the lower mold 31 and which is a concave recessed portion; a wedge-shaped member 513 that determines the position of the cooling cartridge 51 within the cooling slot 36 (see FIG. 6 which will be described later); a cooling water circulation device 52 that is connected to the cooling cartridge 51 through a cooling hose 53; a recovery pan 54 that receives the cooling water which leaks from the cooling cartridge 51 and the cooling hose 53; and a drain pipe 55 that discharges the cooling water recovered with the recovery pan 54.

Figure 5:
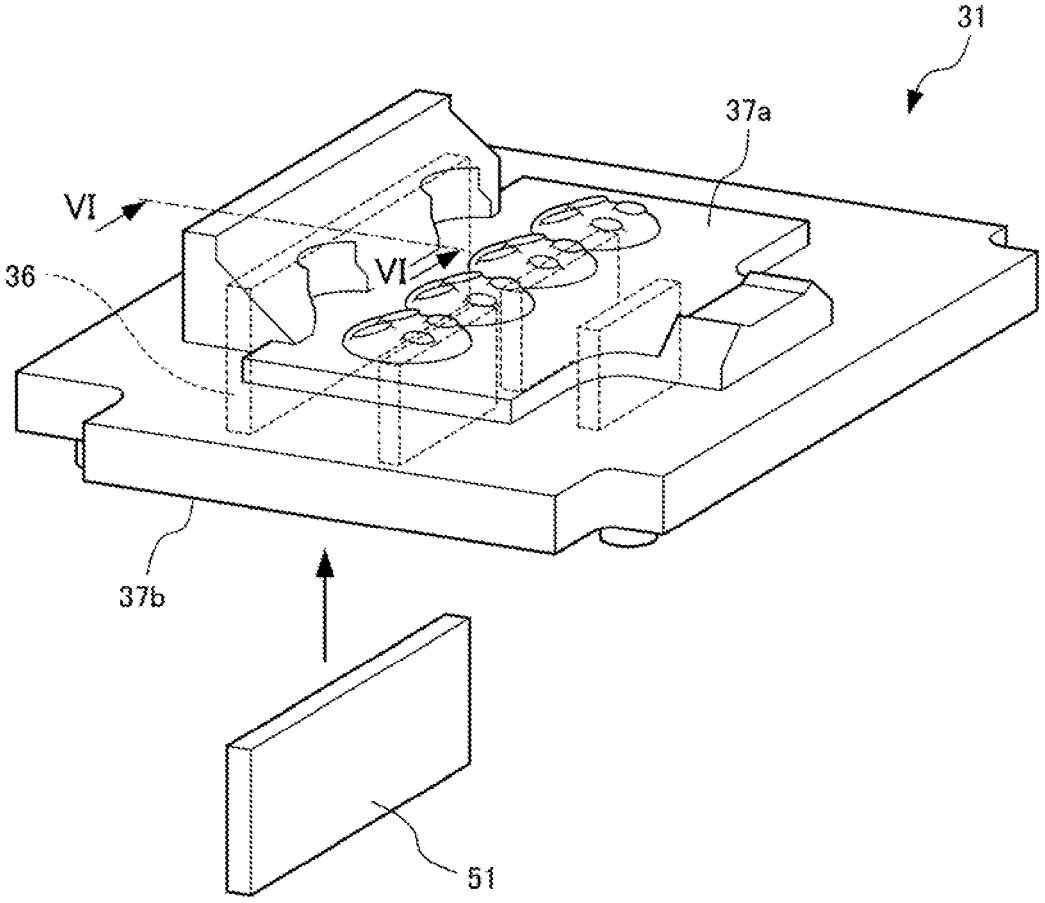
FIG. 5 is a perspective view of a lower mold and a cooling cartridge.
Figure 6:
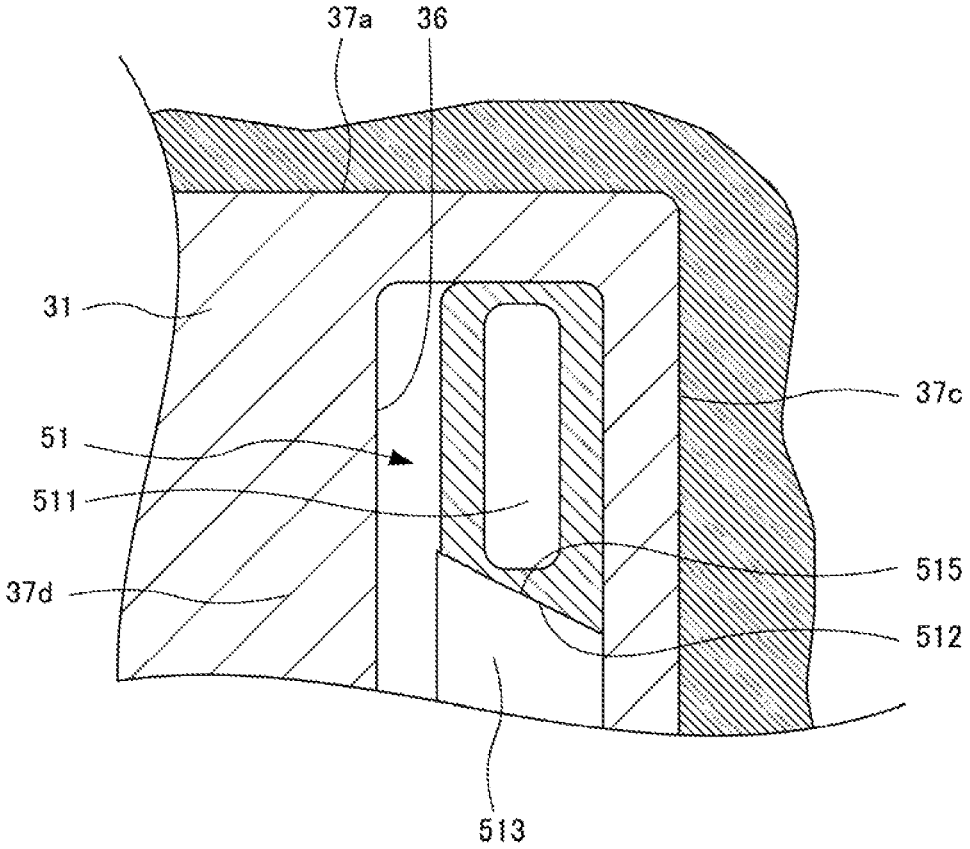
FIG. 6 is a cross-sectional view along line VI-VI of FIG. 5.

FIG. 5 is a perspective view of the lower mold 31 and the cooling cartridge 51 provided in the lower mold 31. More specifically, FIG. 5 is a diagram when the lower mold 31 is seen from the side of a cavity surface 37*a* forming a lower portion of the cavity portion 33. FIG. 6 is a cross-sectional view along line VI-VI in FIG. 5.

In the lower mold 31, in an external wall surface 37*b* on a side opposite to the cavity surface 37*a*, a plurality of cooling slots 36 which are extended along the vertical direction are formed. As shown in FIG. 6, the cooling slot 36 is a rectangular hole in cross-sectional view. These cooling slots 36 are extended from the external wall surface 37*b* toward the vicinity of the wall thickness surface 37*c* of the cavity surface 37*a* which particularly needs to be cooled.

The cooling cartridge 51 is a plate-shaped member whose shape is substantially the same as that of the cooling slot 36. Within the cooling cartridge 51, a cooling water flow path 511 through which the cooling water flows is formed. As shown in FIG. 6, the cooling cartridge 51 is slightly thinner than the cooling slot 36. Hence, when the cooling cartridge 51 is inserted into the cooling slot 36, a gap is formed between the cooling cartridge 51 and the cooling slot 36. In a base end portion of the cooling cartridge 51, an inclined surface 512 is formed which is inclined with respect to the direction of extension of the cooling slot 36, that is, the direction of insertion of the cooling slot 36.

In a tip end portion of the wedge-shaped member 513, an inclined surface 515 is formed which is inclined with respect to the direction of insertion of the cooling slot 36. The position of the cooling cartridge 51 within the cooling slot 36 is determined by the wedge-shaped member 513. Specifically, while the inclined surface 515 of the wedge-shaped member 513 and the inclined surface 512 of the cooling cartridge 51 are made to make sliding contact with each other, the cooling cartridge 51 is pressed with the wedge-shaped member 513 along the direction of insertion of the cooling cartridge 51, and thus as shown in FIG. 6, the cooling cartridge 51 is brought close to the wall thickness surface 37*c* which needs to be cooled, with the result that it is possible to intensively cool the portion which needs to be cooled and to particularly cool, in a pinpoint manner, a portion in which the heat of the mold builds up. As described above, with the wedge-shaped member 513, the position of the cooling cartridge 51 within the cooling slot 36 is determined, and thus the cooling cartridge 51 is separated from a part 37*d* which is located on a side opposite to the wall thickness surface 37*c* that needs to be cooled and which only slightly needs to be cooled, and the gap is formed between the cooling cartridge 51 and the inner wall surface of the cooling cartridge 51, with the result that thermal insulation can be achieved. In this way, it is possible to adjust the cooling in a pinpoint manner on the molten metal in the cavity and the mold. The cooling cartridge 51 as described above is preferably formed of, for example, a material such as copper which has high thermal conductivity.

With reference back to FIG. 1, the cooling hose 53 is a pipe member which connects the cooling water flow path 511 formed within the cooling cartridge 51 and the cooling water circulation device 52. The cooling water circulation device 52 supplies, through the cooling hose 53, the cooling water into the cooling water flow path 511 of the cooling cartridge 51, and also sucks the cooling water so as to circulate the cooling water within the cooling water flow path 511. The cooling hose 53 is provided in the space portion 38 formed between the lower mold 31 and the base 39.

Figure 7:
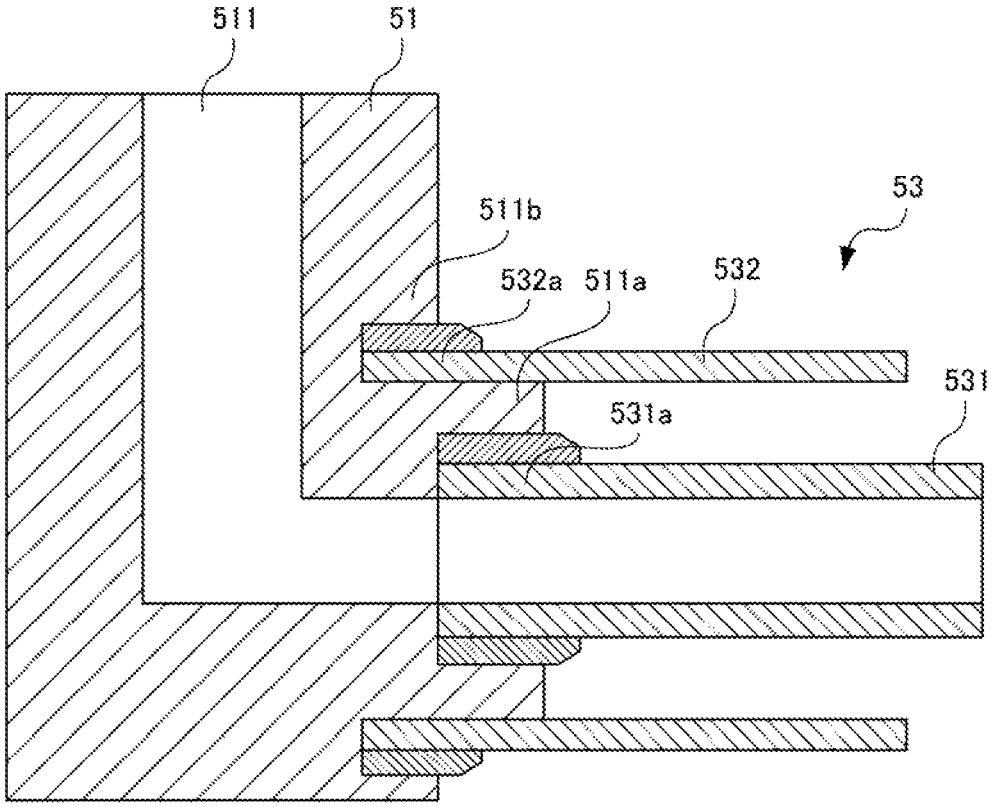
FIG. 7 is a diagram showing a connection structure between a cooling hose and the cooling cartridge.

FIG. 7 is a diagram showing a connection structure between the cooling hose 53 and the cooling cartridge 51. As shown in FIG. 7, the cooling hose 53 is a so-called double pipe, and is formed by combination of an inner pipe 531 and an outer pipe 532 which holds the inner pipe 531. The inner pipe 531 is formed of the same material as the cooling cartridge 51 such as copper. An end portion 531*a* of the inner pipe 531 is bonded to a bonding portion 511*a* formed at an end portion of the cooling water flow path 511 in the cooling cartridge 51, for example, by brazing using silver wax. In the present embodiment, as described above, the same material is used for the cooling cartridge 51 and the inner pipe 531, furthermore, they are bonded with silver wax and thus it is possible to reduce fatigue caused by the heat of the lower mold 31.

As the outer pipe 532, for example, a flexible bellows pipe is used. An end portion 532*a* of the outer pipe 532 is bonded to a bonding portion 511*b* formed in an outer circumferential portion of the bonding portion 511*a* in the cooling cartridge 51, for example, by brazing using silver wax. In the present embodiment, the cooling hose 53 is formed as the double pipe, and thus it is possible to prevent the cooling water leaking from the bonding portion 511*a* of the inner pipe 531 and the cooling water flow path 511 from being scattered to the lower mold 31.

With reference back to FIG. 1, the recovery pan 54 is plate-shaped and covers the side of a lower portion of the mold 3. If the cooling water leaks from the cooling cartridge 51 and the cooling hose 53, this cooling water is recovered with the recovery pan 54 so as to be stored in a concave storage portion 54*a*. The cooling water stored in the storage portion 54*a* is discharged with the drain pipe 55 to the outside of the casting mold device with arbitrary timing. As described above, in the present embodiment, the space portion 38 is formed between the lower mold 31 and the base 39, and thus the recovery pan 54 can be provided in the space portion 38. In this way, the recovery pan 54 can be provided on the side of the lower portion of the mold 3, and thus it is possible to prevent the entry of the leaking cooling water into the stalk chamber 41 and the pressurized furnace 2.

A specific procedure for a casting method of molding the cast product with the casting device 1 as described above will then be described. FIG. 8 is a flowchart showing the specific procedure for the casting method according to the present embodiment.

First, in S1, the molten metal supply device 21 supplies air into the pressurized furnace 2, and thereby increases the pressure within the pressurized furnace 2 so as to fill the molten metal into the stalk portion 6, the sprue portions 7 and 8 and the cavity portion 33. After the pressure within the pressurized furnace 2 is increased in S1, even after the molten metal is filled into the cavity portion 33, the pressure after being increased is maintained until the pressure is reduced in the later step S4. In this way, the riser molten metal is supplied into the cavity portion 33.

Then, in S2, the mold cooling device 5 cools the molten metal filled within the cavity portion 33 until the temperature of the molten metal within the cavity portion 33 is lowered to the solid phase temperature. When the temperature of the molten metal in the cavity portion 33 is lowered to the solid phase temperature, the process is transferred to the subsequent step S3. Preferably, in S2, the sprue portions 7 and 8 are not cooled with the sprue cooling device 9 such that the riser molten metal is supplied into the cavity portion 33.

Then, in S3, the temperature of the molten metal within the cavity portion 33 is lowered to the solid phase temperature, and accordingly, the sprue cooling device 9 starts the cooling of the sprue portions 7 and 8, more specifically, the cooling of the middle inserts 74 of the sprue portions 7 and 8. More specifically, the sprue cooling device 9 circulates, in the middle insert 74, the coolant within the cooling passage 77 which is formed so as to cover at least a part of the entire circumference of the filter member 76, and thereby accelerates the cooling of the middle insert 74, the filter member 76 provided in the middle insert 74 and the molten metal in the part covered with the middle insert 74. The cooling using the sprue cooling device 9 is preferably continued until the temperature of the molten metal in the part covered with the middle insert 74 is lowered to the solid phase temperature.

Then, in S4, the temperature of the molten metal in the part covered with the middle insert 74 is lowered to the solid phase temperature, and accordingly, the molten metal supply device 21 removes the air within the pressurized furnace 2 so as to reduce the pressure within the pressurized furnace 2. Here, in the present embodiment, after the temperature of the molten metal in the part covered with the middle insert 74 is lowered to the solid phase temperature, the pressure within the pressurized furnace 2 is reduced, and thus the molten metal in the part covered with the lower insert 75 and the molten metal filled in the stalk portion 6 can be recovered into the pressurized furnace 2. Here, in order to acquire the amount of molten metal recovered into the pressurized furnace 2 as much as possible, it is preferable to perform the pressure reduction using the molten metal supply device 21 after the temperature of the molten metal in the part covered with the middle insert 74 is lowered to the solid phase temperature and before the temperature of the part covered with the lower insert 75 is lowered to the solid phase temperature.

Then, in S5, the mold is opened, and thus a product design portion and the sprue design portion which are integrally formed by the solidification of the molten metal are removed from the interiors of the cavity portion 33 and the sprue portions 7 and 8. Here, since the pressure within the pressurized furnace 2 is reduced after the temperature of the molten metal within the middle insert 74 in which the filter member 76 is provided is lowered to the solid phase temperature, the filter member 76 can be removed from the sprue portions 7 and 8 together with the sprue design portion.

Figure 8:
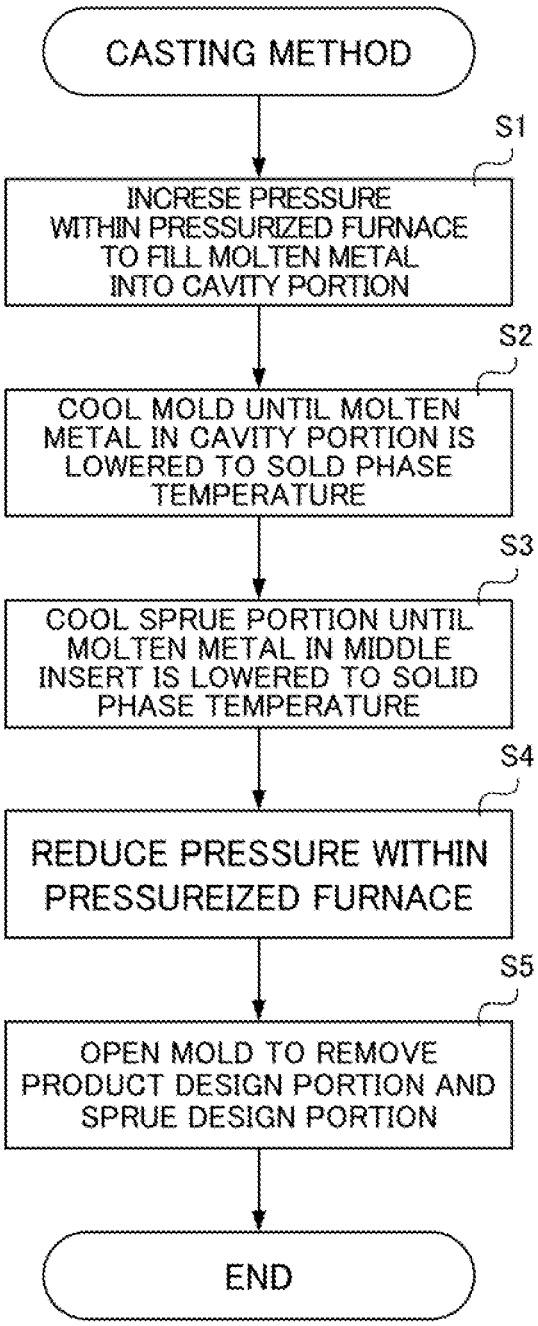
FIG. 8 is a flowchart showing a specific procedure for the casting method.
Figure 9:
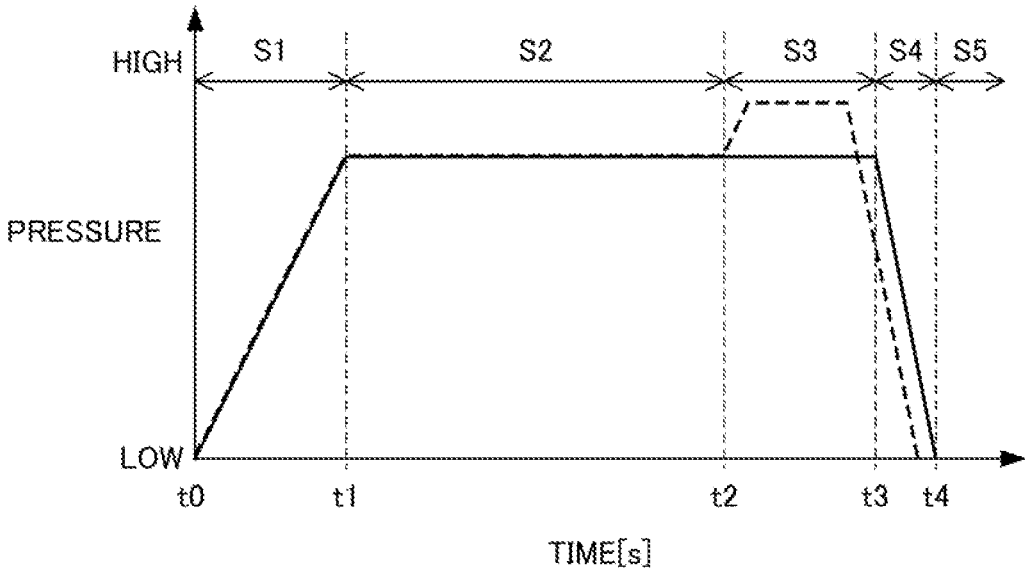
FIG. 9 is a diagram showing changes in pressure within a heating furnace in the individual steps of the casting method of FIG. 8.

FIG. 9 is a diagram showing changes in the pressure within the heating furnace 2 in the individual steps of the casting method of FIG. 8. FIG. 9 shows a case where at time t0, the filling of the molten metal is started, at time t1, the cooling of the molten metal within the cavity portion 33 is started, at time t2, the cooling of the middle insert 74 is started, at time t3, the pressure within the heating furnace 2 is reduced and thereafter at time t4, the mold is opened. In other words, FIG. 9 shows the case where step S1 is performed between time t0 and time t1, step S2 is performed between time t1 and time t2, step S3 is performed between time t2 and time t3, step S4 is performed between time t3 and time t4 and step S5 is performed after time t4.

As shown in FIG. 9, the pressure within the heating furnace 2 is preferably maintained to be substantially constant after the completion of the pressure increase at time t1 until the pressure reduction within the heating furnace 2 is started at time t3. In this way, it is possible to supply the riser molten metal into the cavity portion 33.

Although in the flowchart of FIG. 8, the case where the coolant is made to flow through the cooling passage 77 in step S3 so as to accelerate the cooling of the molten metal is described, a means for accelerating the cooling of the molten metal is not limited to this method. The cooling rate of the molten metal in the part covered with the middle insert 74 can also be increased by temporarily increasing the pressure within the pressurized furnace 2. Hence, in step S3, as described above, the coolant may be made to flow into the cooling passage 77, and as indicated by broken lines in FIG. 9, air may be supplied into the pressurized furnace 2 with the molten metal supply device 21 so as to increase the pressure within the pressurized furnace 2 beyond the pressure within the pressurized furnace 2 in S2.

With the casting device 1 according to the present embodiment, the following effects are achieved.

(1) In the casting device 1, the filter member 76 for removal of a foreign substance is provided in the sprue portions 7 and 8 which connect the stalk portion 6 and the cavity portion 33. In the filter member 76, the flange portion 762 is provided which abuts on the inner wall surface of the sprue portions 7 and 8. In the vicinity of the inner wall surface 741 on which at least the flange portion 762 of the filter member 76 of the sprue portions 7 and 8 abuts, the cooling passage 77 within which the coolant flows is formed. Hence, with the casting device 1, in the molten metal filled within the sprue portions 7 and 8, the solidification of the molten metal in the part including the middle insert 74 on which the flange portion 762 of the filter member 76 abuts is accelerated. Hence, when the mold 3 is opened, the sprue design portion including the filter member 76 can be removed together with the product design portion molded by the solidification of the molten metal within the cavity portion 33. Therefore, in the casting device 1, after the mold is opened, the filter member 76 is prevented from being left within the sprue portions 7 and 8, and thus it is possible to start, with the same stalk portion 6, the same sprue portions 7 and 8 and the same mold 3, the subsequent casting step without performing an operation of removing the filter member 76 from the sprue portions 7 and 8, and it is further possible to reduce the time in which the sprue portions 7 and 8 are solidified, with the result that it is possible to reduce the cycle time.

In the casting device 1, in the vicinity of the inner wall surface 741 of the middle insert 74 with which the flange portion 762 of the filter member 76 is in contact, the cooling passage 77 through which the coolant flows is formed. In the casting device 1, the cooling passage 77 is formed in such a position, and thus it is possible to maintain directional solidification in which the sprue portions 7 and 8 are solidified after the solidification of the cavity portion 33, and hence the riser molten metal function of supplying the pressurized molten metal within the sprue portions 7 and 8 corresponding to the solidification and contraction of the product within the cavity portion 33 is achieved, with the result that the quality of the product can be maintained. When at the same time, the product is solidified, and thus it is not necessary to supply the riser molten metal, the middle insert 74 of the sprue portions 7 and 8 is immediately actively cooled, and thus it is possible to accelerate the solidification of the sprue portions 7 and 8, with the result that it is possible to prevent the filter member 76 from being left in the mold while it is possible to reduce the cycle time after the solidification of the product until the opening of the mold.

(2) In the casting device 1, the sprue portions 7 and 8 are formed by combination of a plurality of inserts 73, 74 and 75. In the middle insert 74, the cooling passage 77 through which the coolant flows is formed. In this way, in the molten metal filled in the sprue portions 7 and 8, the cooling rate in the part covered with the middle insert 74 can be increased as compared with the cooling rate in the part covered with the lower insert 75, with the result that it is possible to reduce the time necessary for the opening of the mold and to prevent the filter member 76 from being left within the middle insert 74.

(3) In the casting device 1, the sprue portions 7 and 8 are inserted into the through holes 34 and 35 formed in the lower mold 31. In cross-sectional view of the sprue portions 7 and 8 along the direction of the flow of the molten metal, the distance from the inner wall surfaces 731 and 741 of the inserts 73 and 74 to the inner wall surfaces 34*a* and 34*b* of the first through hole 34 is set shorter than the distance from the inner wall surface 751 of the lower insert 75 to the inner wall surface 34*c* of the first through hole 34. In this way, as compared with the lower insert 75, in the upper insert 73 and the middle insert 74, the cooling rate caused by heat drawing from the lower mold 31 can be increased. Hence, in the casting device 1, in the molten metal filled in the sprue portions 7 and 8, the cooling rate in the part covered with the upper insert 73 and the middle insert 74 can be increased as compared with the cooling rate in the part covered with the lower insert 75, with the result that it is possible to reduce the time necessary for the opening of the mold and to prevent the filter member 76 from being left within the downstream insert.

(4) In the casting device 1, the part of the sprue portions 7 and 8 on the sprue downstream side is formed by combination of the middle insert 74 and the upper insert 73. In the casting device 1, the middle insert 74 is formed of the material whose thermal conductivity is higher than that of the upper insert 73. In this way, the cooling rate in the upper insert 73 which is closer to the cavity portion 33 than the middle insert 74 is decreased as compared with the cooling rate in the middle insert 74. In this way, while the cooling rate in the middle insert 74 is being increased, it is possible to supply, as the riser molten metal, the molten metal filled within the upper insert 73 into the cavity portion 33. Hence, while the cycle time is being reduced, a good product free from a shrinkage cavity can be manufactured.

(5) In the casting device 1, the void portion 755 is formed between the outer wall surface 752 of the lower insert 75 and the inner wall surface 34*a* of the first through hole 34. In this way, the cooling rate of the molten metal in the part covered with the lower insert 75 can be decreased as compared with the cooling rate of the molten metal in the part covered with the middle insert 74 and the upper insert 73, and thus the maximum amount of molten metal which is returned from the sprue portions 7 and 8 into the pressurized furnace 2 can be acquired, with the result that the cost of the material can be reduced. The void portion 755 as described above is formed, and thus without use of a special material, with a simple configuration, as described above, the maximum amount of molten metal which is returned from the sprue portions 7 and 8 into the pressurized furnace 2 can be acquired, with the result that the cost of the material can be reduced.

(6) In the casting method, the pressure within the pressurized furnace 2 is increased, thus the molten metal is filled into the cavity portion 33 and thereafter the pressure within the pressurized furnace 2 is maintained. Thereafter, in the casting method, after the temperature of the molten metal within the cavity portion 33 is lowered to the solid phase temperature, the middle insert 74 is cooled. In this way, until the molten metal within the cavity portion 33 is solidified and thus the riser molten metal is not needed, the molten metal in the upper insert 73 and the middle insert 74 can be maintained in a liquid phase, with the result that the riser molten metal can be acquired so as to prevent the occurrence of a shrinkage cavity in the product. In the casting method, the pressure within the pressurized furnace 2 is reduced after the temperature of the molten metal within the upper insert 73 and the middle insert 74 is lowered to the solid phase temperature and before the temperature of the molten metal within the lower insert 75 is lowered to the solid phase temperature. In this way, when the mold 3 is opened, the sprue design portion including the filter member 76 can be removed together with the product design portion formed by the solidification of the molten metal within the cavity portion 33. Hence, in the casting method, after the mold is opened, the filter member 76 is prevented from being left within the sprue portions 7 and 8, and thus it is possible to start, with the same stalk portion 6, the same sprue portions 7 and 8 and the same mold 3, the subsequent manufacturing step without performing an operation of removing the filter member 76 from the sprue portions 7 and 8, with the result that it is possible to reduce the cycle time. In a state where the molten metal within the lower insert 75 is in the liquid phase, the pressure within the pressurized furnace 2 is reduced, thus the molten metal within the lower insert 75 can be returned into the pressurized furnace 2 and hence it is possible to reduce an increase in the size of the sprue design portion, with the result that the cost of the material can be reduced.

(7) In the casting method, in step S3 in which the middle insert 74 is cooled, at least any one of the step of making the coolant flow through the cooling passage 77 formed in the middle insert 74 and the step of increasing the pressure within the pressurized furnace 2 as compared with the pressure in step S2 is performed. In this way, in step S3, the temperature of the molten metal within the middle insert 74 can be rapidly lowered to the solid phase temperature, and thus step S4 in which the pressure within the pressurized furnace 2 is reduced can be rapidly started, with the result that it is possible to further reduce the cycle time.

(8) In the casting device 1, the space portion 38 is formed between the mold 3 and the base 39 which supports the mold 3. In the casting device 1, the cooling cartridge 51 for cooling the mold 3 is provided so as to be freely inserted and removed into and from the mold 3, and the cooling hose 53 for the cooling cartridge 51 is further provided in the space portion 38 between the mold 3 and the base 39. In this way, it is possible to cool only an arbitrary portion within the mold 3 which needs to be cooled. In this way, it is also possible to perform cooling control on a high-precision product portion and to cool the wall thickness surface 37*c* of the mold 3 and a complex structure portion, with the result that it is possible to prevent galling and damage caused by the heat of the mold 3.

(9) In the casting device 1, the position of the cooling cartridge 51 within the cooling slot 36 is determined by pressing, with the wedge-shaped member 513, the cooling cartridge 51 along the direction of the insertion. The surfaces of the cooling cartridge 51 and the wedge-shaped member 513 which make sliding contact with each other are set to the inclined surfaces 512 and 515 which are inclined with respect to the direction of the insertion. Hence, in the casting device 1, the cooling cartridge 51 inserted into the cooling slot 36 of the mold 3 is pressed with the wedge-shaped member 513 along the direction of the insertion, and thus the cooling cartridge 51 is made to slide in a vertical direction with respect to the direction of the insertion, with the result that the position within the cooling slot 36 can be determined. In this way, the position of the cooling cartridge 51 within the cooling slot 36 can be brought close to a part of the interior of the mold 3 which is required to be cooled or can be separated from a part which is not required to be cooled, and thus it is possible to perform higher-precision cooling control, with the result that it is possible to increase the life of the mold 3 and to prevent galling with the product.

Although the embodiment of the present invention has been described above, the present invention is not limited to this embodiment. For example, although in the embodiment described above, the case where the present invention is applied to the casting device 1 which is used when a cast product is molded based on the low pressure casting method is described, the present invention is not limited to this case. The present invention is applied not only to the low pressure casting method but also to a casting device which is used when a cast product is molded based on a so-called gravity casting method in which molten metal is filled into a cavity portion by utilization of the weight of the molten metal.

Although in the embodiment described above, the case where the void portion 755 is formed between the lower insert 75 and the first through hole 34 is described, the present invention is not limited to this case. In order to further enhance the thermal insulation effect of the lower insert 75, a thermal insulation member may be provided in the void portion 755.

EXPLANATION OF REFERENCE NUMERALS

1: casting device
2: pressurized furnace (furnace)
21: molten metal supply device
3: mold
31: lower mold
32: upper mold
33: cavity portion
34: first through hole (through hole)
34*a*, 34*b*, 34*c*: inner wall surface
35: second through hole (through hole)
38: space portion
39: base
5: mold cooling device (cooling means)
51: cooling cartridge (cooling member)
513: wedge-shaped member (locating member)
53: cooling hose (coolant pipe)
6: stalk portion (stalk portion)
7: first sprue portion (sprue portion)
73: upper insert (downstream insert, second downstream insert, downstream sprue portion)
731: inner wall surface
74: middle insert (abutting portion, downstream insert, first downstream insert, downstream sprue portion)
741: inner wall surface
77: cooling passage
75: lower insert (upstream insert, upstream sprue portion)
751: inner wall surface
752: outer wall surface
755: void portion (thermal insulation portion)
76: filter member
762: flange portion
8: second sprue portion (sprue portion)
9: sprue cooling device

The invention claimed is:

1. A casting device comprising: a furnace which stores molten metal;

a mold within which a cavity portion is formed;

a cylindrical stalk portion which is provided in the furnace;

a molten metal supply device which supplies the molten metal within the furnace to the stalk portion;

at least one sprue portion which is a cylindrical member that connects an end portion of the stalk portion on a downstream side in a molten metal filling direction and the cavity portion and which guides the molten metal supplied to the stalk portion into the cavity portion; and a filter member which is provided in the at least one sprue portion, wherein the filter member includes a flange portion which is extended along a direction of extension of the at least one sprue portion and which abuts on an abutting portion of an inner wall surface of the sprue portion, in a vicinity of the abutting portion, a cooling passage within which a coolant flows is provided, the at least one sprue portion is formed by combination of an upstream insert which forms a portion of the at least one sprue portion on a side of the stalk portion from an end portion of the abutting portion on an upstream side in the molten metal filling direction and a downstream insert which forms a portion of the at least one sprue portion on a side of the cavity portion from the end portion of the abutting portion on the upstream side in the molten metal filling direction, the cooling passage is formed in the downstream insert, the at least one sprue portion is provided by being inserted into a through hole formed in the mold such that an end portion of the downstream insert on the downstream side in the molten metal filling direction communicates with an interior of the cavity portion and a thermal insulation portion is formed between an outer wall surface of the upstream insert and an inner wall surface of the through hole.

2. The casting device according to claim 1, wherein the at least one sprue portion is provided by being inserted into the through hole formed in the mold such that the end portion of the downstream insert on the downstream side in the molten metal filling direction communicates with the cavity portion, and in cross-sectional view of the at least one sprue portion along the molten metal filling direction, a distance from an inner wall surface of the downstream insert to the inner wall surface of the through hole is shorter than a distance from an inner wall surface of the upstream insert to the inner wall surface of the through hole.

3. The casting device according to claim 2, wherein the downstream insert is formed by combination of a first downstream insert which is a cylindrical member and which includes the abutting portion and a second downstream insert which is a cylindrical member and which forms a portion of the downstream insert on the side of the cavity portion with respect to the first downstream insert, and the first downstream insert is formed of a material whose thermal conductivity is higher than the second downstream insert.

4. The casting device according to claim 3, wherein the thermal insulation portion is a void which is formed between the outer wall surface of the upstream insert and the inner wall surface of the through hole.

5. The casting device according to claim 4, further comprising: a sprue cooling device which makes the coolant flow through the cooling passage according to a temperature of the molten metal within the cavity portion being lowered to a solid phase temperature.

6. The casting device according to claim 3, further comprising: a sprue cooling device which makes the coolant flow through the cooling passage according to a temperature of the molten metal within the cavity portion being lowered to a solid phase temperature.

7. The casting device according to claim 2, wherein the thermal insulation portion is a void which is formed between the outer wall surface of the upstream insert and the inner wall surface of the through hole.

8. The casting device according to claim 2, further comprising: a sprue cooling device which makes the coolant flow through the cooling passage according to a temperature of the molten metal within the cavity portion being lowered to a solid phase temperature.

9. The casting device according to claim 1, wherein the downstream insert is formed by combination of a first downstream insert which is a cylindrical member and which includes the abutting portion and a second downstream insert which is a cylindrical member and which forms a portion of the downstream insert on the side of the cavity portion with respect to the first downstream insert, and the first downstream insert is formed of a material whose thermal conductivity is higher than the second downstream insert.

10. The casting device according to claim 9, wherein the thermal insulation portion is a void which is formed between the outer wall surface of the upstream insert and the inner wall surface of the through hole.

11. The casting device according to claim 9, further comprising: a sprue cooling device which makes the coolant flow through the cooling passage according to a temperature of the molten metal within the cavity portion being lowered to a solid phase temperature.

12. The casting device according to claim 1, wherein the thermal insulation portion is a void which is formed between the outer wall surface of the upstream insert and the inner wall surface of the through hole.

13. The casting device according to claim 12, further comprising: a sprue cooling device which makes the coolant flow through the cooling passage according to a temperature of the molten metal within the cavity portion being lowered to a solid phase temperature.

14. The casting device according to claim 1, further comprising: a sprue cooling device which makes the coolant flow through the cooling passage according to a temperature of the molten metal within the cavity portion being lowered to a solid phase temperature.

* * * * *